US008495790B2

(12) United States Patent
Forbes et al.

(10) Patent No.: US 8,495,790 B2
(45) **Date of Patent: *Jul. 30, 2013**

(54) CLEANER HEAD

(75) Inventors: Steven John Forbes, Malmesbury (GB); Spencer James Robert Arthey, Malmesbury (GB); Jean-Paul Mark Iles, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/325,849

(22) Filed: Dec. 14, 2011

(65) Prior Publication Data

US 2012/0144620 A1 Jun. 14, 2012

(30) Foreign Application Priority Data

Dec. 14, 2010 (GB) ..... 1021192.8
Dec. 14, 2010 (GB) ..... 1021193.6

(51) Int. Cl.
*A47L 9/04* (2006.01)

(52) U.S. Cl.
USPC ..... 15/384; 15/385; 15/389; 15/180; 15/201

(58) Field of Classification Search
USPC ..... 15/383–385, 50.3, 52.1, 179, 180, 15/201, 389
IPC ..... A47L 9/04
See application file for complete search history.

(56) References Cited

U.S. PATENT DOCUMENTS

| | | | |
|---|---|---|---|
| 2,881,466 | A | 4/1959 | Bramhall |
| 2,904,816 | A | 9/1959 | Skolfield |
| 2,904,817 | A | 9/1959 | Brennan |
| 2003/0051301 | A1 | 3/2003 | Morgan et al. |
| 2006/0162119 | A1 | 7/2006 | Smith |
| 2006/0272121 | A1 | 12/2006 | Wai |
| 2008/0172818 | A1 | 7/2008 | Yoo |
| 2009/0229075 | A1 | 9/2009 | Eriksson |
| 2012/0144619 | A1 | 6/2012 | Forbes et al. |
| 2012/0144621 | A1 | 6/2012 | Forbes et al. |

FOREIGN PATENT DOCUMENTS

| | | |
|---|---|---|
| CN | 201171656 | 12/2008 |
| DE | 20 2006 004 827 | 6/2006 |
| EP | 0 254 833 | 2/1988 |
| EP | 1 769 711 | 4/2007 |

(Continued)

OTHER PUBLICATIONS

Search Report and Written Opinion mailed Mar. 12, 2012, directed to International Patent Application No. PCT/GB2011/052226;11 pages.

(Continued)

*Primary Examiner* — David Redding
(74) *Attorney, Agent, or Firm* — Morrison & Foerster LLP

(57) ABSTRACT

A cleaner head for a cleaning appliance includes a rotatable agitator and an agitator chamber housing the agitator. The agitator includes a flexible body and surface engaging members mounted on the body. The agitator chamber includes a downwardly-directed opening through which debris energized by the surface engaging members enters the cleaner head. The opening is located in a plane. The cleaner head includes a drive mechanism for rotating the agitator about a rotational axis which is inclined both relative to the plane of the opening and towards the rear of the opening so that, with rotation of the agitator, the surface engaging members protrude through the opening towards the front of the opening.

23 Claims, 12 Drawing Sheets

FOREIGN PATENT DOCUMENTS

| | | |
|---|---|---|
| EP | 1 949 841 | 7/2008 |
| EP | 2 218 385 | 8/2010 |
| ES | 2 025 089 | 3/1992 |
| GB | 754512 | 8/1956 |
| GB | 2 021 937 | 12/1979 |
| GB | 2 406 042 | 3/2005 |
| JP | 2-77219 | 3/1990 |
| JP | 6-30862 | 2/1994 |
| JP | 7-322983 | 12/1995 |
| JP | 8-228974 | 9/1996 |
| JP | 2004-57365 | 2/2004 |
| JP | 2006-314747 | 11/2006 |
| JP | 2008-178661 | 8/2008 |
| JP | 2009-148398 | 7/2009 |
| WO | WO-2004/028330 | 4/2004 |

OTHER PUBLICATIONS

Forbes et al., U.S. Office Action dated Feb. 1, 2013, directed to U.S. Appl. No. 13/325,944; 4 pages.

B - B

A - A

CLEANER HEAD

REFERENCE TO RELATED APPLICATIONS

This application claims the priority of United Kingdom Application Nos. 1021192.8, and 1021193.6, each filed Dec. 14, 2010, the entire contents of which are incorporated herein by reference.

FIELD OF THE INVENTION

The present invention relates to a cleaner head for a cleaning appliance. In a preferred embodiment, the cleaner head is suitable for use with a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening and the cleaner head, and into the main body. The suction opening is directed downwardly to face the floor surface to be cleaned. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement.

Vacuum cleaners generally include cylinder, or canister, cleaners, upright cleaners and hand-held cleaners. A cylinder vacuum cleaner includes a main body supported by a set of wheels which is dragged along a floor surface by a hose and wand assembly extending between the main body and the cleaner head. The cleaner head is generally releasably attached to the end of the wand which is remote from the main body. An upright vacuum cleaner typically comprises a main body, a rolling assembly mounted on the main body for maneuvering the vacuum cleaner over a floor surface to be cleaned, and a cleaner head mounted on the main body. In use, a user reclines the main body of the upright vacuum cleaner towards the floor surface, and then sequentially pushes and pulls a handle which is attached to the main body to maneuver the vacuum cleaner over the floor surface.

A driven agitator, usually in the form of a brush bar, may be rotatably mounted within a brush bar chamber of the cleaner head. The brush bar comprises an elongate cylindrical core bearing bristles which extend radially outward from the core. The bristles are generally provided in clumps or tufts of bristles spaced about and along the core of the brush bar. The suction opening is located at the bottom of the brush bar chamber, and the brush bar is mounted within the chamber so as to protrude by a small extent through the suction opening. An exhaust port of the brush bar chamber is generally located towards the rear of the brush bar chamber. The exhaust port is usually in the form of a circular or rectangular aperture formed in the brush bar chamber.

The brush bar is activated mainly when the vacuum cleaner is used to clean carpeted surfaces. Rotation of the brush bar about its longitudinal axis may be driven by an electric motor powered by a power supply derived from the main body of the cleaner, or by a turbine driven by an air flow passing through or into the cleaner head. For example, WO2004/028330 describes a cleaner head having a turbine assembly for driving the rotation of a brush bar of the cleaner head. The turbine assembly comprises a vaned impeller which is mounted within a housing for rotation relative to a guide vane plate. The housing is located on one side of the floor tool. The impeller is connected to the brush bar by a pulley system. The housing has an air outlet connected to a suction duct extending between the suction opening and the main body of the vacuum cleaning appliance, and an air inlet for admitting ambient air into the housing. When the appliance is switched on, ambient air is drawn through the housing, causing the impeller to rotate and drive the rotation of the brush bar.

The rotation of the brush bar causes the bristles to be swept between the fibers of the carpet to be cleaned, agitating both the fibers of the carpet and any debris, such as dust particles, fibers and hairs, located on the surface of the carpet and/or between the fibers of the carpet. As the bristles are swept between the fibers, the force applied to the bristles by the carpet causes the bristles to splay, resulting in some debris becoming lodged between the bristles. As the bristles are rotated away from the fibers, the motion of the bristles as they return to their normal configuration tends to cause dust particles or other relatively small items of debris to be dislodged from the tufts of bristles. However, debris such as fibers and hairs can remain trapped between the bristles. With the rotation of the brush bar about its longitudinal axis, any such trapped fibers tend to move inwardly towards the core of the brush bar, resulting in the fibers becoming wrapped around the core of the brush bar. The user is then required to remove these hairs and fibers manually from the brush bar from time to time.

During a cleaning operation, a relatively high torque may be applied to the bristles of the brush bar, especially during the cleaning of a rug or a deeply piled carpet. To restrict the magnitude of the torque applied to the brush bar, and thereby reduce the risk of the brush bar stalling during a cleaning operation, the brush bar may be provided with relatively soft bristles, and/or a relatively low density of bristle tufts over the outer surface of the core of the brush bar. While reducing the risk of the brush bar stalling during the cleaning of deeply piled carpets, the provision of soft bristles and/or a low number of bristles tufts can impair the cleaning performance of the cleaner head when used on short piled carpets.

SUMMARY OF THE INVENTION

In a first aspect, the present invention provides a cleaner head for a cleaning appliance, the cleaner head comprising a rotatable agitator comprising a drive shaft, a flexible body connected to the drive shaft and at least one surface engaging member mounted on the body, an agitator chamber housing the agitator, the agitator chamber comprising a downwardly-directed opening through which debris energized by said at least one surface engaging member enters the cleaner head, the opening being located in a plane, and a system for rotating the agitator about a rotational axis of the drive shaft, the rotational axis being inclined both relative to the plane of the opening and towards the rear of the opening so that, with rotation of the agitator, said at least one surface engaging member protrudes through the opening towards the front of the opening.

As an alternative to providing a cleaner head with an agitator in the form of a cylindrical brush bar which is rotatable about its longitudinal axis, in this first aspect the present invention provides a cleaner head with a rotatable agitator comprising a drive shaft having a rotational axis about which the agitator is rotated during use of the cleaner head, a flexible body connected to the drive shaft and at least one surface engaging member mounted on the body for engaging a surface to be cleaned.

The flexible body is preferably annular in shape, and preferably provides at least a flexible outer peripheral portion of the agitator. For example, the flexible body may be located about a central core of the agitator. Alternatively, the body may have flexible portions on which surface engaging members are mounted, and so the term "flexible body" includes both a body comprising a single flexible member or portion, and a body including a plurality of flexible members or flexible portions.

The surface engaging members are preferably in the form of a plurality of bristles mounted on the body. These bristles have a first extremity, or tip, for engaging the surface to be cleaned, and a second extremity located opposite to the first extremity. For example, this second extremity may be the other end of the bristle, but where the bristle is bent or otherwise shaped so that both ends of the bristles contact the surface to be cleaned, this second extremity may be located midway between the ends of the bristles. The bristles may be arranged in a plurality of bristle tufts or clumps mounted on the body, or in a plurality of substantially continuous rows mounted on the body.

Alternatively, or additionally, said at least one surface engaging member may comprise at least one strip of resilient material, or other resilient surface engaging members. The surface engaging members preferably have a greater stiffness than the body of the agitator, and are preferably formed from nylon.

As another alternative, said at least one surface engaging member may comprise a cleaning pad attached to the body, in which case the first extremity of the pad corresponds to the cleaning surface of the pad, and the second extremity of the pad corresponds to the surface of the pad which is attached to the body.

As a further alternative, the surface engaging members may be integral with the body. For example, the surface engaging members may comprise raised portions of the body.

The agitator is housed within an agitator chamber having a downwardly-directed opening through which debris energized by, for example, the bristles enters the cleaner head. The cleaner head comprises a system for rotating the agitator about the rotational axis of the drive shaft. The rotational axis is inclined both relative to the plane of the opening and towards the rear of the opening so that, with rotation of the agitator, the bristles protrude through the opening towards the front of the opening. The rotational axis preferably passes through the center of the body. Where the body is generally planar in shape, the rotational axis is preferably substantially orthogonal to the body.

The rotational axis is thus preferably disposed relative to the opening such that, with each revolution of the agitator, each bristle protrudes through the opening during only part of that revolution. In other words, each bristle protrudes through the opening during a first period of the revolution of the bristle about the rotational axis of the drive shaft, whereas the bristle is located above the opening during a second period of the revolution of the bristle about the rotational axis of the drive shaft.

The rotational axis preferably passes through the opening. An angle subtended between the rotational axis and the plane of the opening is preferably between 70 and 90°.

The agitator is preferably disposed relative to the opening so that the body is inclined relative to the plane of the opening. At least the center of the body, and preferably substantially all of the body, may be located above the plane of the opening. The length of the bristles may be selected so that when the cleaner head is located on a surface to be cleaned, and with the opening facing this surface, each bristle protrudes through the opening during less than two thirds, preferably less than one half of a revolution of the bristle about the rotational axis of the agitator.

As the tips of the bristles of, for example, a bristle tuft engage the surface to be cleaned, the portion of the flexible body bearing that bristle tuft flexes upwardly relative to the drive shaft of the agitator. This can allow the tips of the bristles to be swept over the surface to be cleaned in an arc located in a plane which is generally parallel to the surface to be cleaned. By sweeping the bristles in an arc over the surface to be cleaned, and by preferably locating those bristles on a flexible body, the torque applied to the bristles during, for example, the cleaning of a deeply piled carpet or rug can be significantly lower than that which is applied to the bristles of a cylindrical brush bar during a similar cleaning operation. Consequently, the risk of the agitator stalling during the cleaning of a deeply piled carpet or a rug can be relatively low, and this can allow the stiffness of the bristles to be increased without increasing significantly the likelihood of the agitator stalling during cleaning. The flexibility of the body can accommodate for any unevenness in the surface to be cleaned, thereby allowing the tips of the bristles to be drawn over an uneven surface without any significant variation in the torque applied to the bristles by the floor surface. Also, as the bristles wear during use of the cleaner head, the body flexes by a smaller amount to compensate for the wear of the bristles and maintain the engagement between the tips of the bristles and the surface to be cleaned.

Furthermore, the movement of the tips of the bristles over the surface of a carpet tends to cause any fibers or hairs located on the surface of the carpet to agglomerate into a mass located in front of and/or beneath the tips of the bristles as they are swept over the surface of the carpet. This mass of fibers can be readily entrained within an air flow generated by a vacuum cleaning appliance to which the cleaner head is attached, and which enters the cleaner head through the opening in the agitator chamber.

The body is preferably inclined relative to the plane of the opening so that, with rotation of the agitator, the bristles protrude through the opening towards the front of the opening. This can facilitate the use of the tool for the removal of individual hairs or a clump of hairs from a surface, as a user instinctively locates the cleaner head immediately behind the hairs to be removed and moves the cleaner head over the hairs so that at least the front portion of the cleaner head passes over the hairs. Locating the area of the surface which is swept by the bristles beneath and towards the front of the opening can maximize the likelihood that the bristles will come into contact with the hairs during the rotation of the agitator.

As an alternative to locating the bristles or other surface engaging members on a flexible body, the bristles may be located on a substantially rigid body which is moveable relative to the drive shaft of the agitator upon engagement between the tip of the bristle and the surface to be cleaned. For example, the body may be connected to the drive shaft by a flexible coupling or a universal joint which allows the body to move relative to the drive shaft upon engagement between the tip of the bristle and the surface to be cleaned. The flexible coupling may allow the body to move along the rotational axis of the drive shaft upon engagement between the tip of the bristle and the surface to be cleaned, or it may allow the body to pivot relative to the drive shaft upon engagement between the tip of the bristle and the surface to be cleaned.

In each of the above examples, at least the part of the body to which the bristle is connected is moveable, preferably vertically moveable, relative to the drive shaft upon engagement between the tip of the bristle and the surface to be cleaned. However, the bristles may not be rigidly connected to the body of the agitator so as to allow a degree of movement of the second extremity of each bristle relative to the drive shaft as the bristle engages the surface to be cleaned. Therefore, in a second aspect the present invention provides a cleaner head for a cleaning appliance, the cleaner head comprising a rotatable agitator comprising a drive shaft, a body connected to the drive shaft, and at least one surface engaging member mounted on the body, each surface engaging member having a first extremity for engaging a surface to be cleaned and a second extremity located opposite to the first extremity which is moveable relative to the drive shaft upon engagement between the first extremity and the surface, an agitator chamber housing the agitator, the agitator chamber comprising a downwardly-directed opening through which debris energized by said at least one surface engaging member enters the cleaner head, the opening being located in a plane, and a system for rotating the agitator about a rotational axis of the drive shaft, the rotational axis being inclined both relative to the plane of the opening and towards the rear of the opening so that, with rotation of the agitator, said at least one surface engaging member protrudes through the opening towards the front of the opening.

In a preferred embodiment the body is generally planar in shape. The body may be in the form of a flexible pad, and may be formed from flexible sheet material. The body may be formed by stamping the body from a sheet of flexible material, but alternatively, the body may be overmolded on to the drive shaft or other part of the agitator. The body is preferably formed from silicone, elastomer, polyurethane or other rubber-like elastic material.

The thickness of the body is preferably in the range from 1 to 10 mm, more preferably in the range from 2 to 5 mm. An angle subtended between the plane of the opening and a plane parallel to the body is preferably between 0 and 20°.

Alternatively, the body may be non-planar in shape. For example, the body may be curved, convex or dome-shaped, or otherwise symmetrical about an axis passing through the center of the body. The bristles or other surface engaging members may be located on a flat, flexible portion of the body, for example a flexible rim of the body.

The body may be circular, and the bristles may be regularly spaced about the body so that during one rotation of the body a relatively constant torque is applied to the body upon contact between the bristles and the surface to be cleaned. Alternatively, the body may be non-circular so that bristles protrude through the opening during only part of that revolution. As a result, the torque applied to the body, and thus to a drive mechanism for rotating the agitator, may vary between at least one maximum value when at least some—or a relatively large number—of the bristles are in contact with a surface to be cleaned and at least one minimum value when no—or a relatively small number of—bristles are in contact with the surface to be cleaned.

The body may have n-fold rotational symmetry, where n is an integer equal to or greater than 2. For example, the body may be generally rectangular, triangular, square or have another polygonal shape. Alternatively, the body may be generally elliptical in shape. As another alternative, the body may be asymmetric. For example, the body may be in the form of an arm which rotates about the rotational axis of the drive shaft.

As mentioned earlier, the body preferably comprises a plurality of bristles mounted on the body. These bristles may substantially cover the lower surface of the body. Alternatively, the bristles may be arranged in an annular arrangement over the lower surface of the body. In a preferred embodiment, the bristles are arranged in a plurality of rows of bristle tufts mounted on the body. Each row of bristle tufts may be secured to a bristle retaining member, which is in turn attached to the body. For example, each bristle retaining member is preferably located within an aperture formed in the body, the body thus providing a continuous surface surrounding the bristle retaining member. The bristle retaining member may be retained by means of an interference fit between the body and the bristle retaining member. Alternatively, the continuous surface may be gripped between opposing portions of the bristle retaining member. For example the opposing portions of the bristle retaining member may define a groove for receiving the periphery of each aperture, with the width of the groove being smaller than the thickness of the body so that the elastic energy stored in the flexible body as it is deformed to enter the groove retains the bristle retaining member within the aperture. This allows the bristle retaining member to be secured manually to the flexible body.

As mentioned above, each bristle retaining member comprises a row of bristle tufts. The agitator may comprise a plurality of sets of bristles, each set of bristles comprising a plurality of rows of bristle tufts, and with each set of bristles being located at or towards a respective end or corner of the body.

The apertures are preferably arranged so that the rows of bristles are substantially parallel. For example, the rows of bristles may be arranged substantially parallel to a major radius of the body. Alternatively, the rows of bristles may be radially aligned on the body.

The cleaner head is preferably connectable to a vacuum cleaning appliance for drawing an air flow through the cleaner head. The air flow preferably enters the cleaner head through the opening, and passes through the agitator chamber to an air outlet. The air outlet is preferably connectable to a hose and wand assembly for conveying the air flow to the cleaning appliance. Alternatively, the cleaner head may be attached to the main body of an upright cleaning appliance, or to the main body of a handheld cleaning appliance.

The agitator may be rotated in a single angular direction about the rotational axis of the drive shaft. Alternatively, the agitator may be rotated sequentially in two different angular directions about the drive shaft.

The agitator may be rotated about the rotational axis of the drive shaft by any suitable mechanism. For example, the agitator may be rotated under the force of friction between the surface engaging members and a wheel which rotates as the cleaner head is moved over the surface. Preferably, the cleaner head comprises a drive mechanism for rotating the agitator. The drive mechanism may be connected to a motor for driving a fan of a vacuum cleaning appliance to which the cleaner head is attached. Alternatively, the agitator may be driven by a dedicated motor located in the cleaner head. The motor may be supplied with power from the vacuum cleaning appliance, for example through electrical connectors located in a hose and wand assembly for connecting the cleaner head to the vacuum cleaning appliance. Alternatively, the cleaner head may comprise a battery for supplying power to the motor.

The drive mechanism is preferably arranged to rotate the agitator at a speed in the range from 500 to 5,000 rpm. In a preferred embodiment, the drive mechanism is arranged to rotate the agitator at a speed of around 2,500 rpm.

To reduce the power consumption of the cleaner head, or of a vacuum cleaning appliance attached to the cleaner head, the cleaner head preferably comprises an air turbine assembly comprising an impeller for driving the agitator. The agitator may be driven directly by the impeller, or a drive mechanism may be provided for connecting the agitator to the impeller. Such a drive mechanism is preferably located above the agitator. The drive mechanism preferably comprises a plurality of drive components. The drive components may comprise one or more belts connecting the impeller to the agitator, but in a preferred embodiment the drive components comprises a plurality of gears. Each drive component preferably has a respective rotational axis, and the rotational axes of the drive components are preferably parallel to at least one of the rotational axis of the agitator and the rotational axis of the impeller.

The opening is preferably arranged to admit a first air flow into the agitator chamber, and the impeller may be driven by this first air flow. Alternatively, the cleaner head may comprise a turbine air inlet for admitting a second air flow, separate from the first air flow, to the turbine assembly and a duct for receiving the first air flow from the agitator chamber and the second air flow from the turbine assembly, and which conveys the air flows to the air outlet of the cleaner head.

Preferably, the opening and the turbine air inlet are located on opposite sides of the cleaner head. The opening is preferably located on a lower surface of cleaner head, and the turbine air inlet is preferably located on an upper surface of the cleaner head. The turbine air inlet may be located on an upwardly facing portion of the upper surface of the cleaner head. Alternatively, the turbine air inlet may be located on an annular portion of the upper surface so as to extend about the turbine assembly. The location of air inlet on the upper surface of the cleaner head can enable the cleaner head to have a relatively low profile to facilitate cleaning beneath items of furniture, for example.

The duct preferably comprises an upper section for receiving the first air flow from the turbine air inlet, and a lower section for receiving the second air flow from the opening. The drive mechanism may be conveniently mounted on a support, which may be in the form of a wall or other structural partition located between the opening and the turbine air inlet. The turbine air inlet is preferably located behind the agitator assembly, and/or behind the opening.

The body is preferably located within the agitator chamber so that only part of the body is located directly above the opening at any given time. The remainder of the body is preferably located above a trailing section of the sole plate.

With the inclination of the body to the plane of the opening, the extent of the deformation of a bristle mounted on the body will tend to vary during the first period of the revolution of the bristle about the rotational axis of the agitator. There is thus a tendency for the bristles of a bristle tuft to splay by a varying amount during the first period of their revolution about the rotational axis of the agitator, allowing items of debris of varying sizes to become trapped between the bristles as they subsequently relax upon movement of the bristle tuft away from the surface to be cleaned. The inventors have found that this can improve the pick-up performance of the cleaner head in comparison to one in which the body is substantially parallel to the plane of the opening.

As the bristle tuft is rotated above the opening during the second period of its revolution about the rotational axis of the agitator, debris trapped between the bristles can be drawn from between the bristles and entrained within the air flow passing through the cleaner head. To promote the release of these items of debris from between the bristles, the cleaner head may comprise a bristle agitating surface located within the agitator chamber and over which, with rotation of the agitator, the bristles are swept to cause the bristles to splay and release debris from between the bristles. The released debris can then become entrained within an air flow passing through the cleaner head.

In a third aspect the present invention provides a cleaner head for a vacuum cleaning appliance, the cleaner head comprising a rotatable agitator assembly for sweeping debris from a surface, an agitator chamber housing the agitator assembly, the agitator chamber comprising a downwardly-directed opening through which debris energized by the agitator assembly enters the cleaner head, the agitator assembly comprising a plurality of resilient bristles which protrude downwardly through the opening with rotation of the agitator assembly, and at least one bristle agitating surface located within the agitator chamber and over which, with rotation of the agitator assembly, the bristles are swept to dislodge debris from the bristles.

The agitating surface is preferably located adjacent the opening. The opening preferably has a front edge and a rear edge, and the agitating surface is preferably located adjacent the rear edge of the opening so as to engage the bristles when they are located behind the opening, reducing the risk of any debris dislodged from the bristles falling through the opening and on to the surface being cleaned.

The cleaner head preferably comprises a sole plate defining the opening of the agitator chamber. The agitating surface is preferably connected to the sole plate, and is more preferably integral with the sole plate. The sole plate may be removable to allow a user to clear any blockages within the agitator chamber, or to allow the user to replace part of the agitator assembly. For example, the user may wish to replace a broken part of the agitator, or to replace the body of the agitator assembly with a different body, for example one bearing different surface engaging members. The cleaner head may be supplied with a set of bodies, each having a respective different surface engaging member. For example, a first body may have relatively stiff bristles, a second body may have relatively flexible bristles, and a third body may have a polishing pad for engaging the surface to be cleaned.

As mentioned above, the opening is located within a plane, and the agitating surface is preferably inclined to the plane of the opening. The agitating surface is preferably in the form of a ramp over which the bristles are swept. The angle of inclination of the ramp to the plane may vary along the length of the ramp. Alternatively, this angle may be relatively constant along the length of the ramp. The ramp may be curved, and may extend in an arc about the rotational axis of the agitator so that each bristle is in contact with the ramp over a period of the revolution of the bristle about the rotational axis of the agitator. For example, the agitating surface may extend about the rotational axis of the agitator by an angle in the range from 30 to 90°. Alternatively each bristle may contact the ramp towards the end of the ramp.

The cleaner head may comprise a single agitator bearing bristles or other surface engaging members for engaging a surface to be cleaned. Alternatively, the cleaner head may comprise an agitator assembly comprising a plurality of agitators. The agitators are preferably substantially the same, and are preferably located side by side within the agitator chamber. In a preferred embodiment the agitator assembly comprises two agitators, but the agitator assembly may comprise three or more agitators. These agitators may be regularly spaced within the agitator chamber. The agitators may be arranged linearly, in the shape of an arc, or in any desired geometric shape within the agitator chamber.

The rotational axes of the agitators are preferably parallel, and located in a plane which is preferably inclined to the plane of the opening, and which preferably passes through the opening. Alternatively, the bodies of the agitators may be located in respective different planes. These planes may be parallel, or they may intersect.

The cleaner head preferably comprises a plurality of bristle agitating surfaces each located adjacent to the opening and over which bristles of a respective agitator are swept with rotation of the agitator assembly to dislodge matter from the bristles.

Each agitator may be driven by a respective air turbine assembly. However, a single air turbine assembly is preferably connected to the agitators so that the agitators are driven simultaneously by the impeller of that turbine assembly. A drive mechanism for connecting the agitators to the impeller is preferably arranged to rotate the agitators in opposite directions. The directions in which the agitators are rotated by the drive mechanism is preferably such that each bristle is rotated from a position located towards the front of the opening to a position located towards the center of the opening, and from there over the rear edge of the opening.

The first agitator is preferably angularly offset about its rotational axis from the second agitator. The first agitator is preferably angularly offset from the second agitator by an angle in the range from 45° to 90°. By angularly offsetting the agitators, the path swept by the bristles of the first agitator may intersect the path swept by the bristles of the second agitator without the bodies colliding during rotation. Not only can this reduce the width of the cleaner head, but it can also minimize the size of any un-swept areas located between the agitators.

Each body may be circular, with the surface engaging members, or bristles, extending outwardly from each body so that the path of the bristles of the first agitator overlaps the path of the bristles of the second agitator. However, in a preferred embodiment each agitator comprises a non-circular, preferably disc-shaped body, with the body of the first agitator being angularly offset about its rotational axis from the body of the second agitator so that the path of the body of the first agitator intersects the path of the body of the second agitator.

The bodies are preferably substantially co-planar, and the paths swept by the bodies are preferably substantially co-planar. As mentioned above, the cleaner head preferably comprises an agitator chamber housing the agitators, the agitator chamber comprising a downwardly-directed opening through which debris energized by the surface engaging members enters the cleaner head, and wherein the surface engaging members protrude downwardly through the opening with rotation of the agitators. The bodies are preferably rotated so that the bristles move inwardly from the front of the opening towards the middle of the opening. The paths of the surface engaging members preferably overlap towards the middle of the opening.

The surface engaging members preferably comprises a plurality of surface engaging members, such as bristles, bristle strips, bristle tufts or strips of flexible material. Each body is preferably inclined relative to the plane of the opening so that, with rotation of the agitator, the surface engaging members protrude through the opening. With the bodies being non-circular, the surface engaging members may protrude through the opening during only part of that revolution. As a result, the torque applied to the bodies, and thus to a drive system for rotating the agitators, may vary between at least one maximum value when a relatively large number of surface engaging members are in contact simultaneously with a surface to be cleaned and at least one minimum value when a relatively small number of surface engaging members are in contact simultaneously with the surface to be cleaned. To reduce the size of this maximum value of the torque when the agitator assembly comprises a plurality of agitators, the surface engaging members of the first agitator are preferably angularly offset from the surface engaging members of the second agitator.

The surface engaging members are preferably arranged in a plurality of sets of surface engaging members mounted on the body. The sets of surface engaging members are preferably angular spaced, more preferably substantially evenly angularly spaced, about a rotational axis of the body. Preferably, each set of surface engaging members is located at or towards a respective end or corner of the body, and so depending on the shape of the body the sets of surface engaging members may be spaced by an angle in the range from 60 to 180°. The sets of surface engaging members of the first agitator are preferably angularly offset from the sets of surface engaging members of the second agitator by an angle in the range from 45° to 90°.

Features described above in connection with the first aspect of the invention are equally applicable to any of the second to third aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
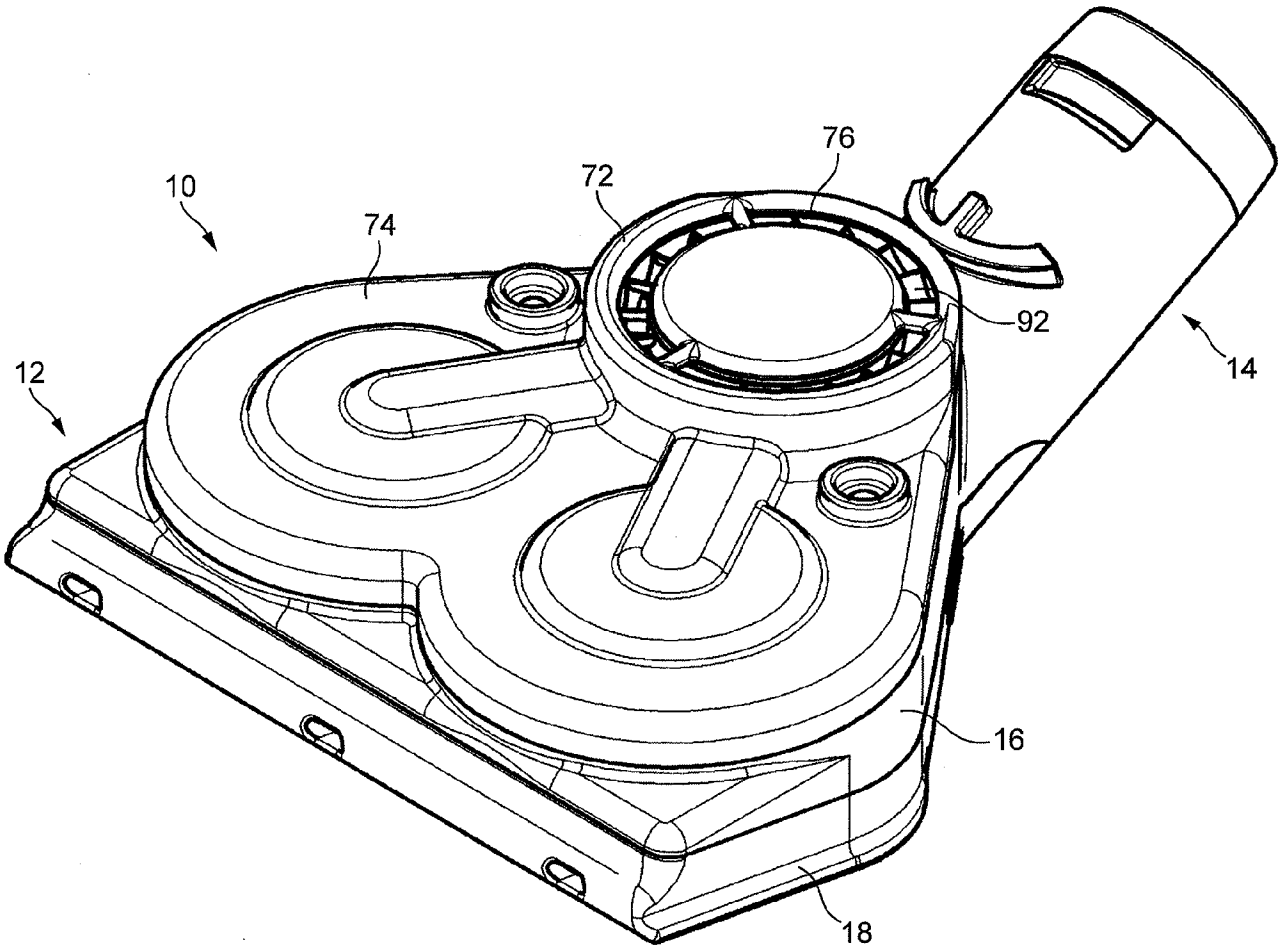
FIG. 1 is a front perspective view, from above, of a cleaner head.
Figure 2:
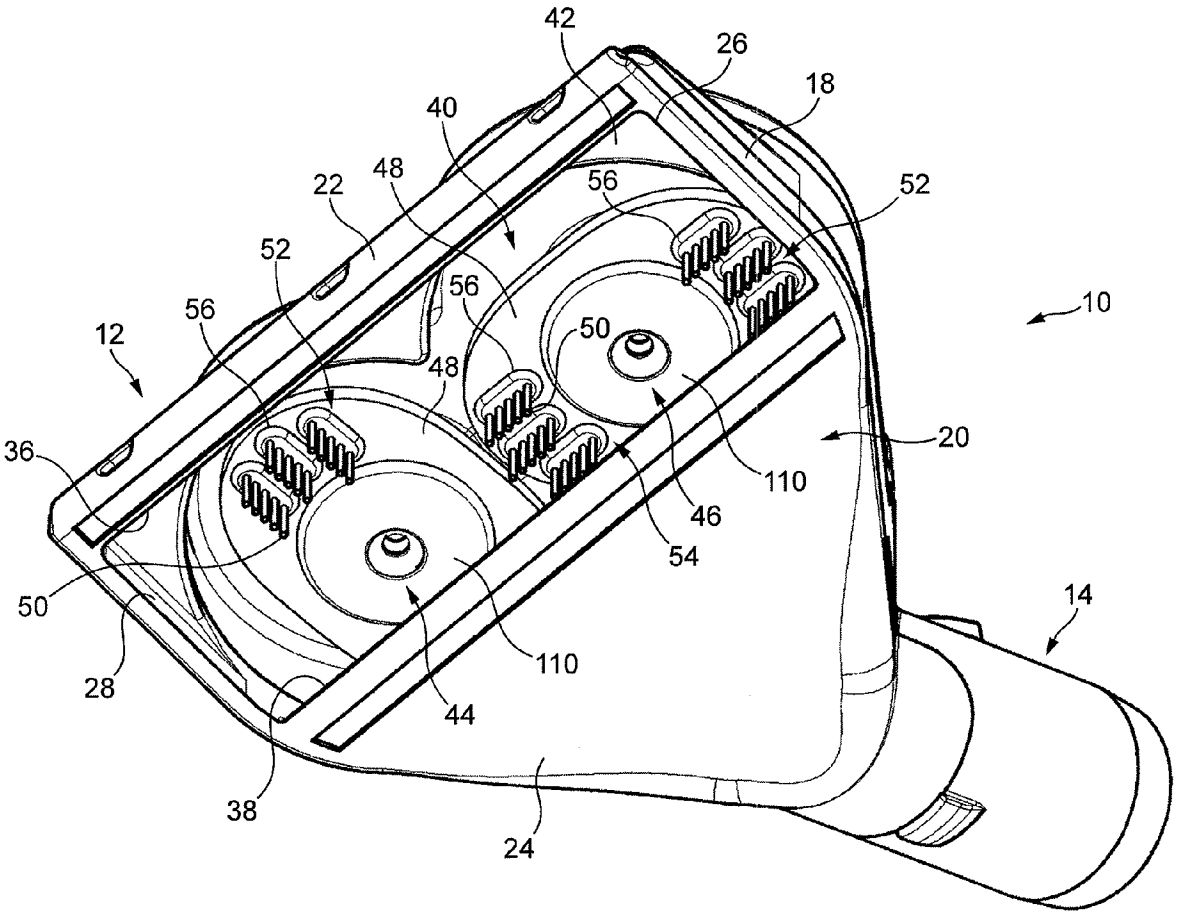
FIG. 2 is a front perspective view, from below, of the cleaner head.
Figure 3:
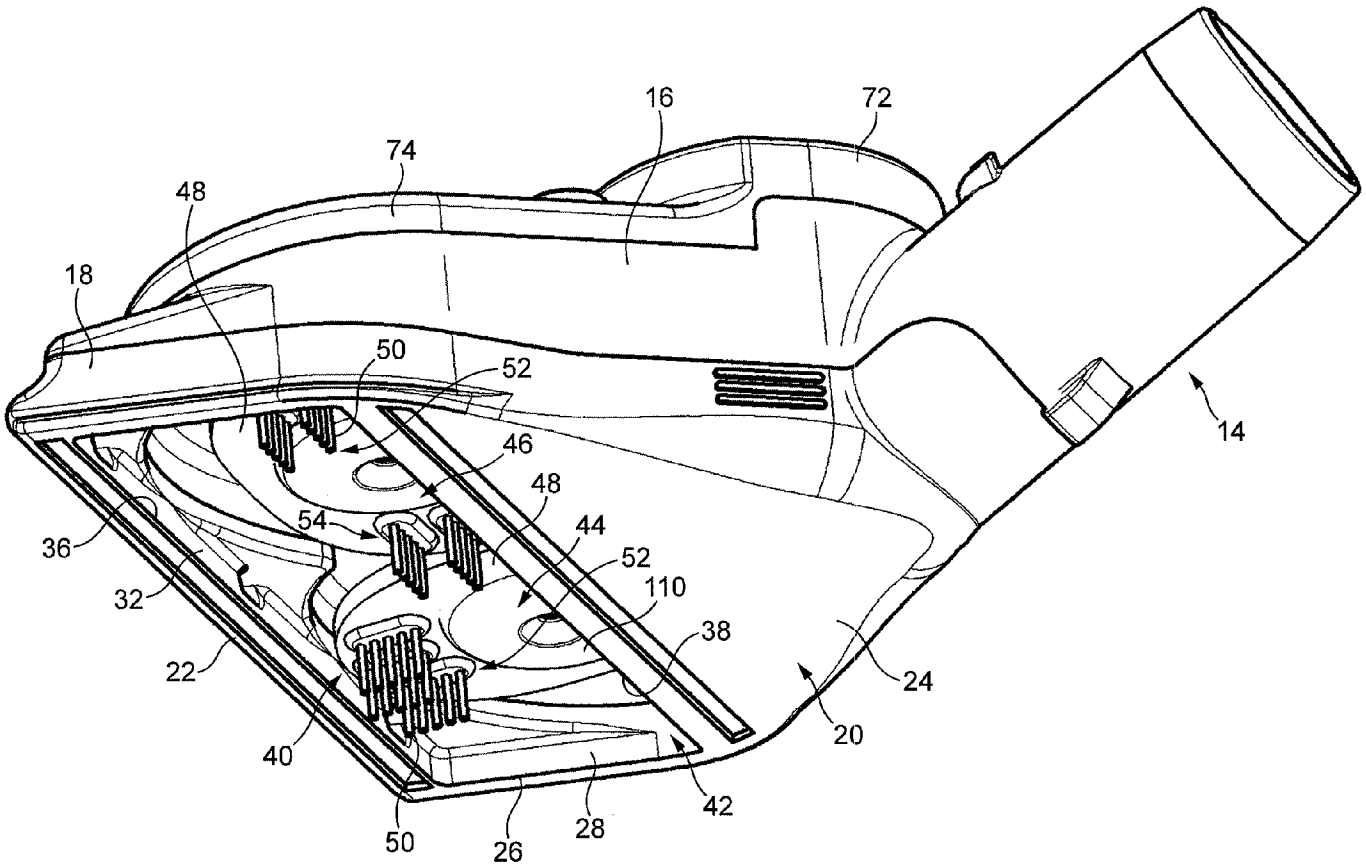
FIG. 3 is a rear perspective view, from below, of the cleaner head.

FIGS. 1 to 7 illustrate external views of a cleaner head 10 for a vacuum cleaning appliance. In this embodiment, the cleaner head 10 is arranged to be connectable to a wand or hose of a cylinder vacuum cleaning appliance. The cleaner head 10 comprises a main body 12 and a conduit 14 connected to the main body 12. The main body 12 comprises an upper body section 16 and a lower body section, or sole plate, 18 connected to the upper body section 16. In this example, the conduit 14 is integral with the upper body section 16, but it may be connected to the upper body section 16, for example by welding or using an adhesive. The conduit 14 is connectable to a wand of a hose and wand assembly of the vacuum cleaning appliance (not shown). The vacuum cleaning appliance comprises a fan assembly for drawing an air flow through the cleaner head. The sole plate 18 may be removable from the upper body section 16 of the main body 12.

Figure 4:
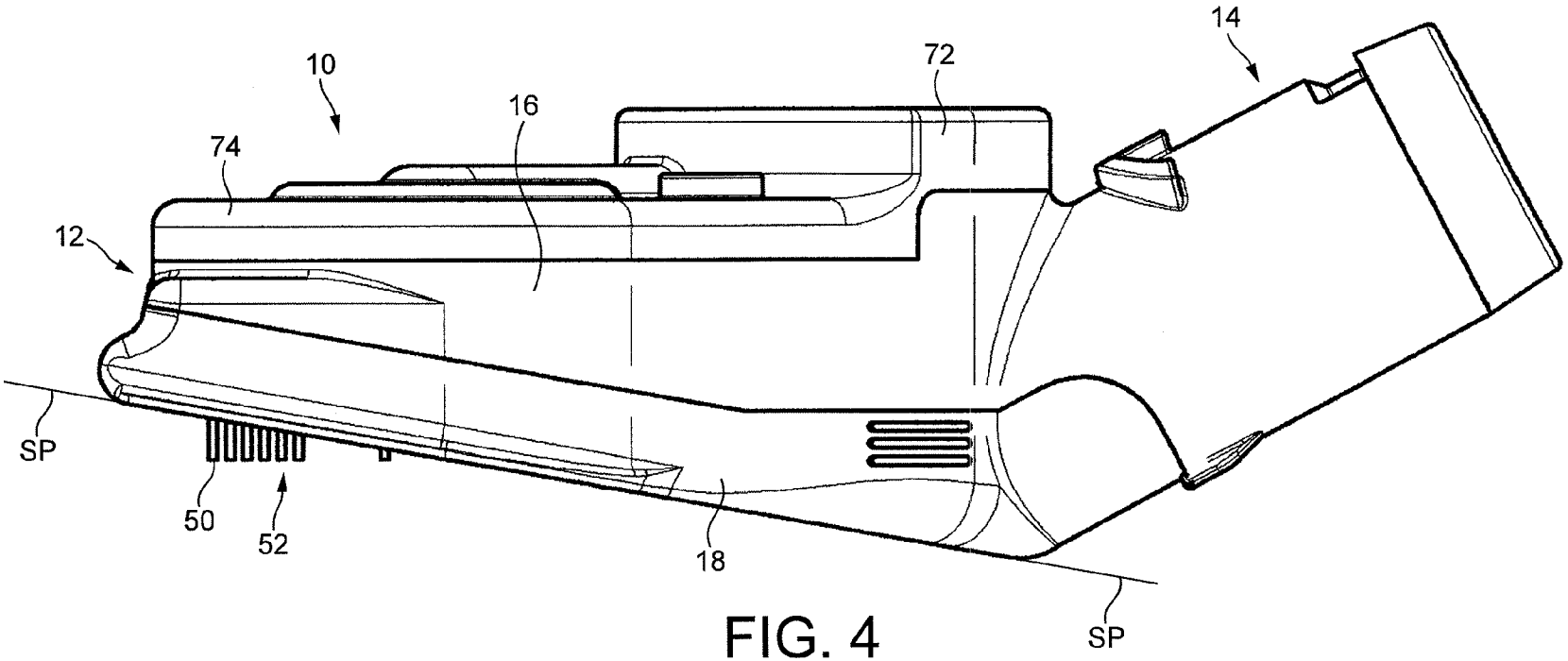
FIG. 4 is a left side view of the cleaner head.
Figure 5:
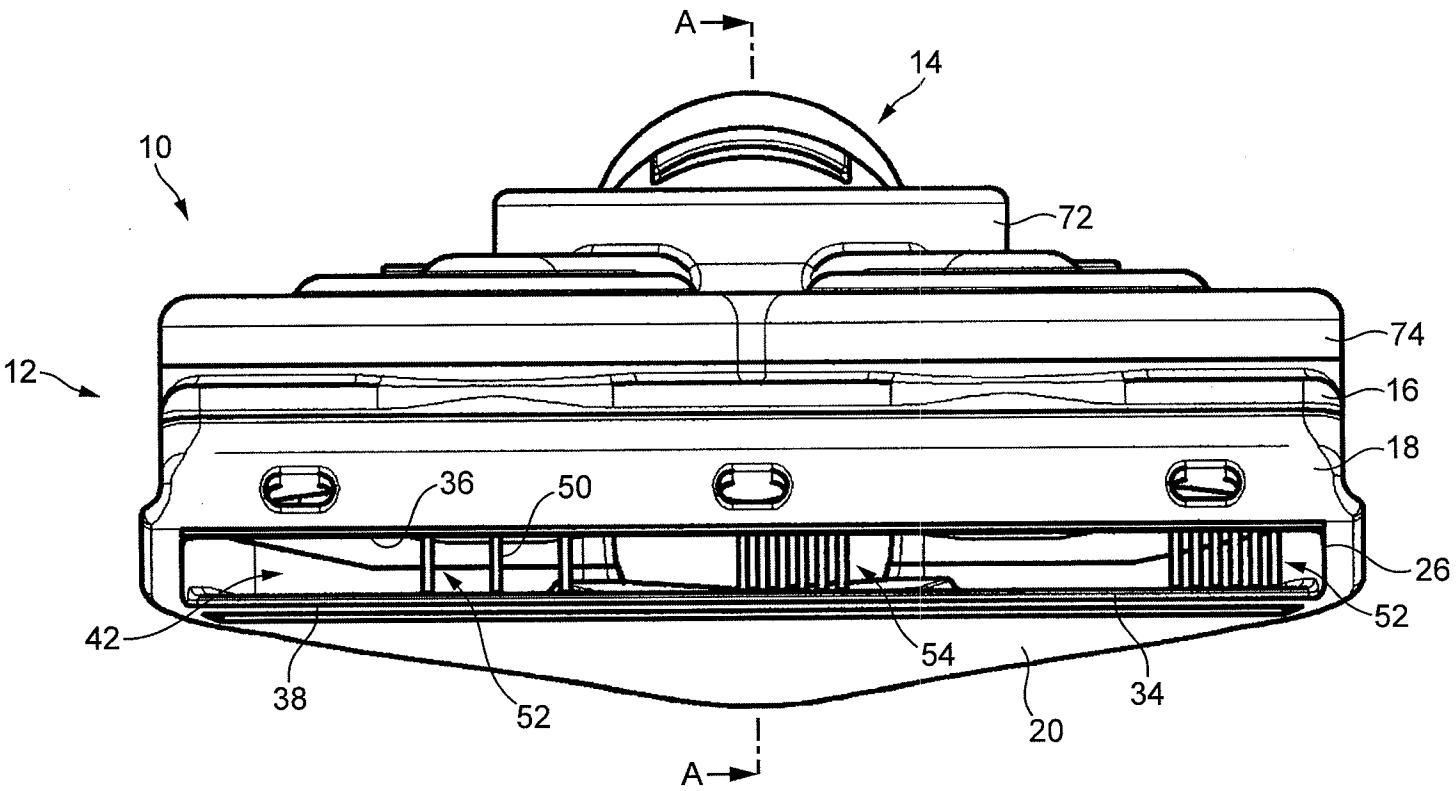
FIG. 5 is a front view of the cleaner head.
Figure 6:
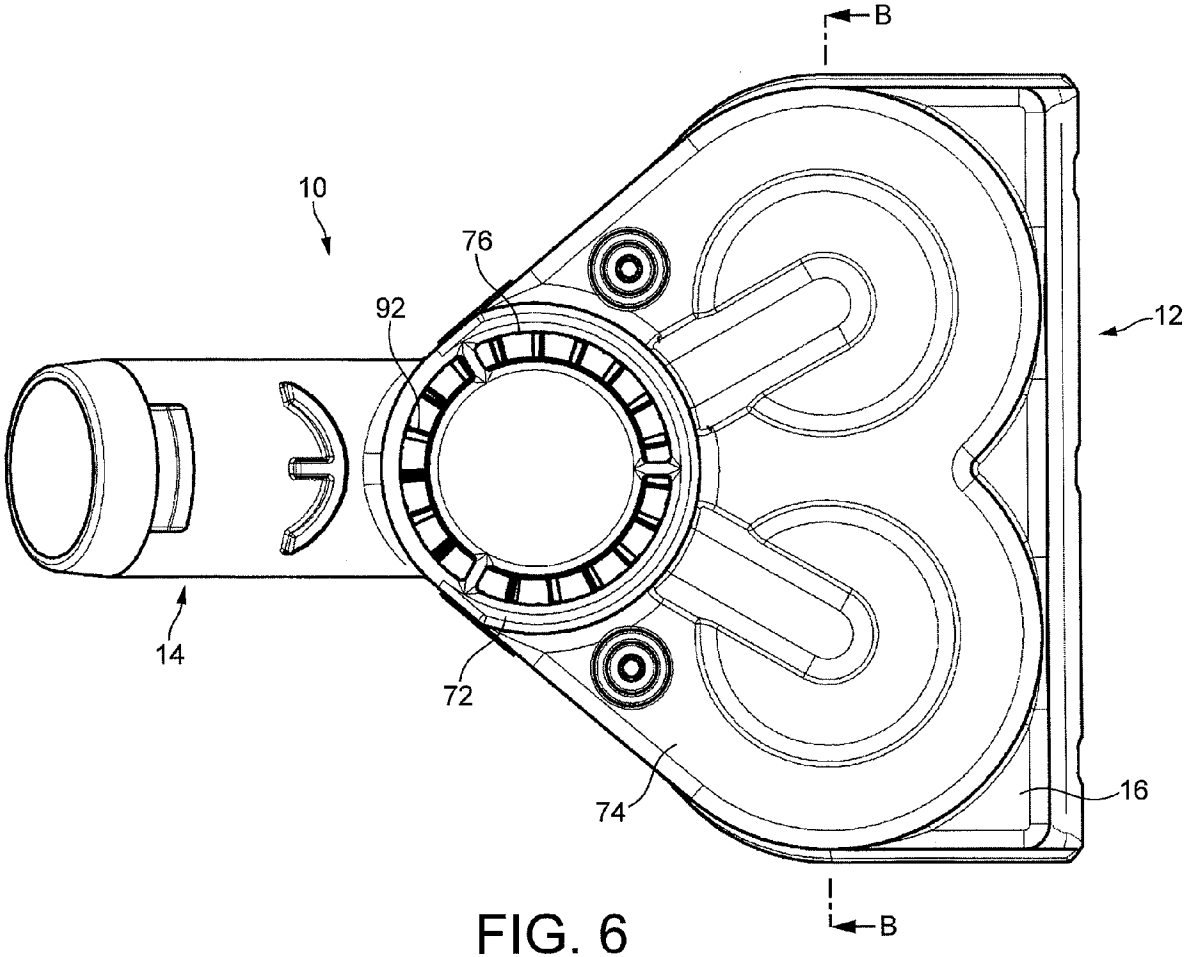
FIG. 6 is a top view of the cleaner head.
Figure 7:
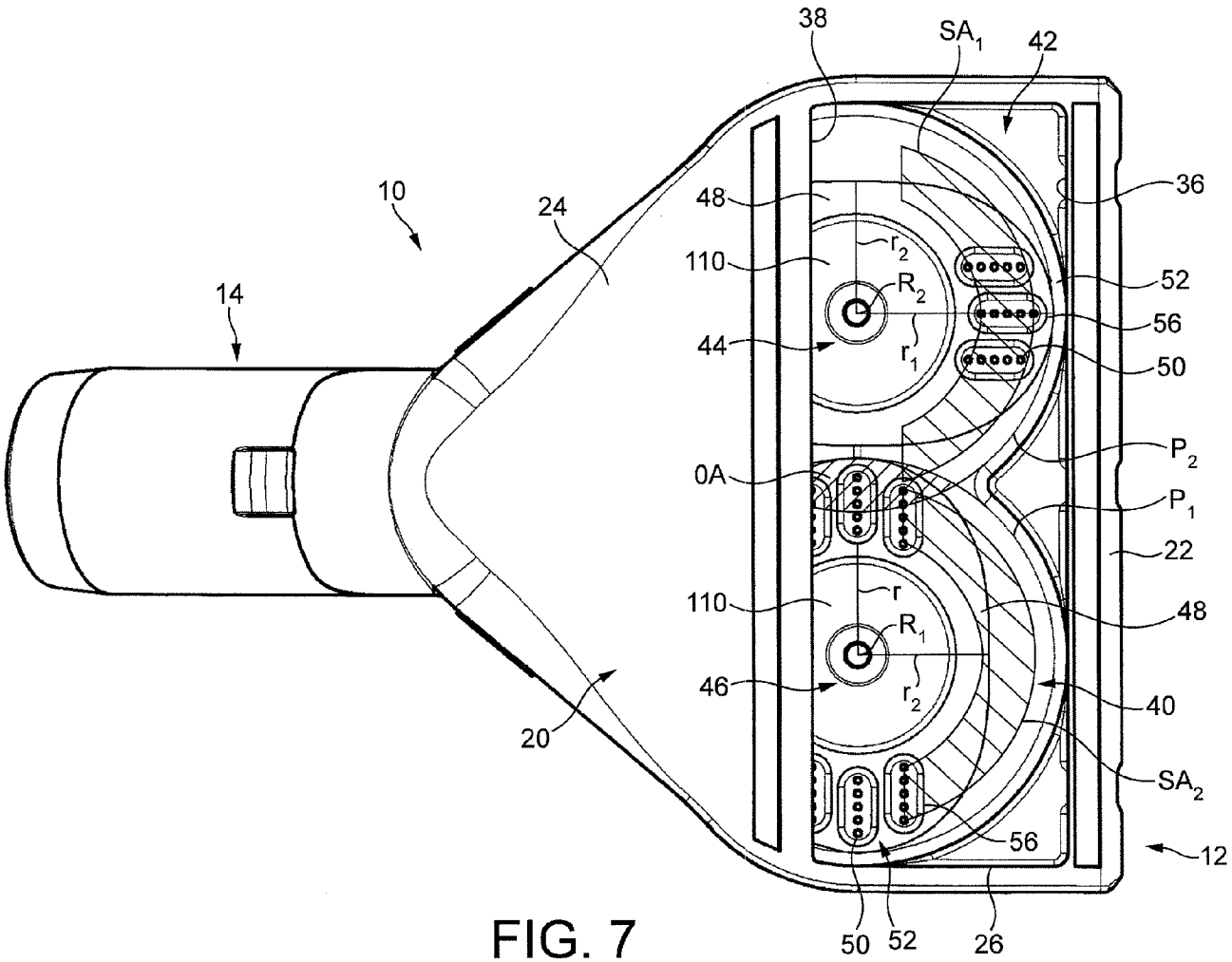
FIG. 7 is a bottom view of the cleaner head.
Figure 8:
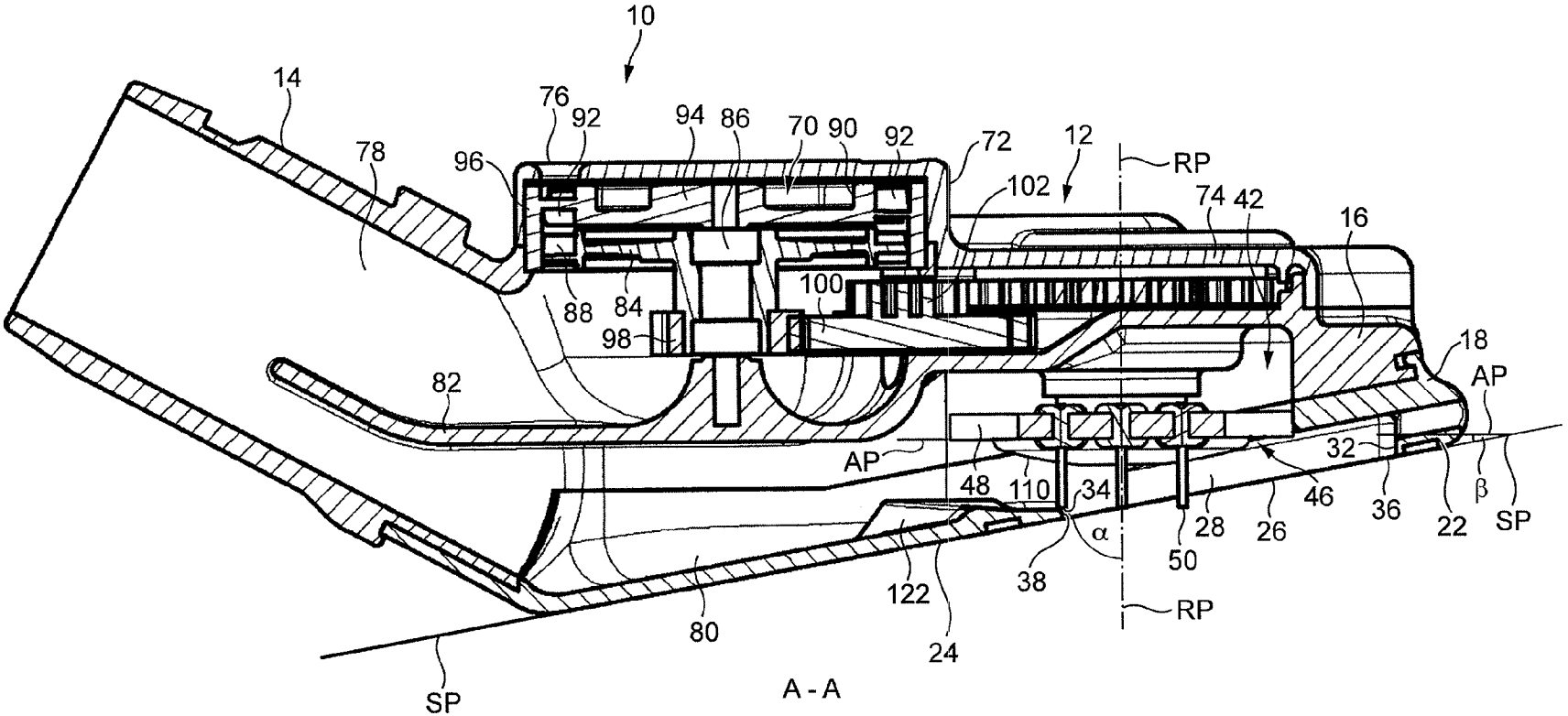
FIG. 8 is a side sectional view taken along line A-A in FIG. 5.
Figure 9:
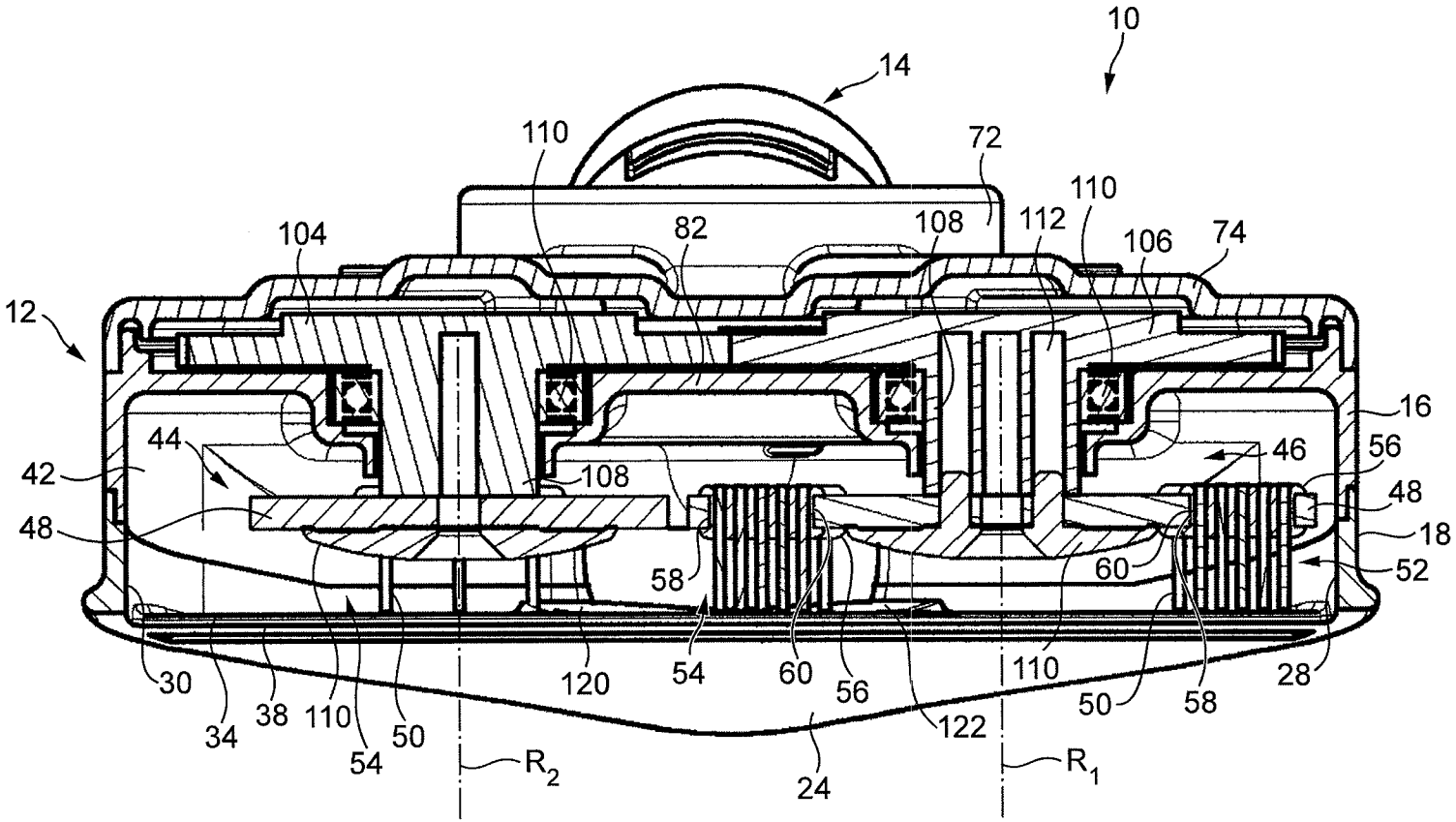
FIG. 9 is a front sectional view taken along line B-B in FIG. 6.
Figure 10:
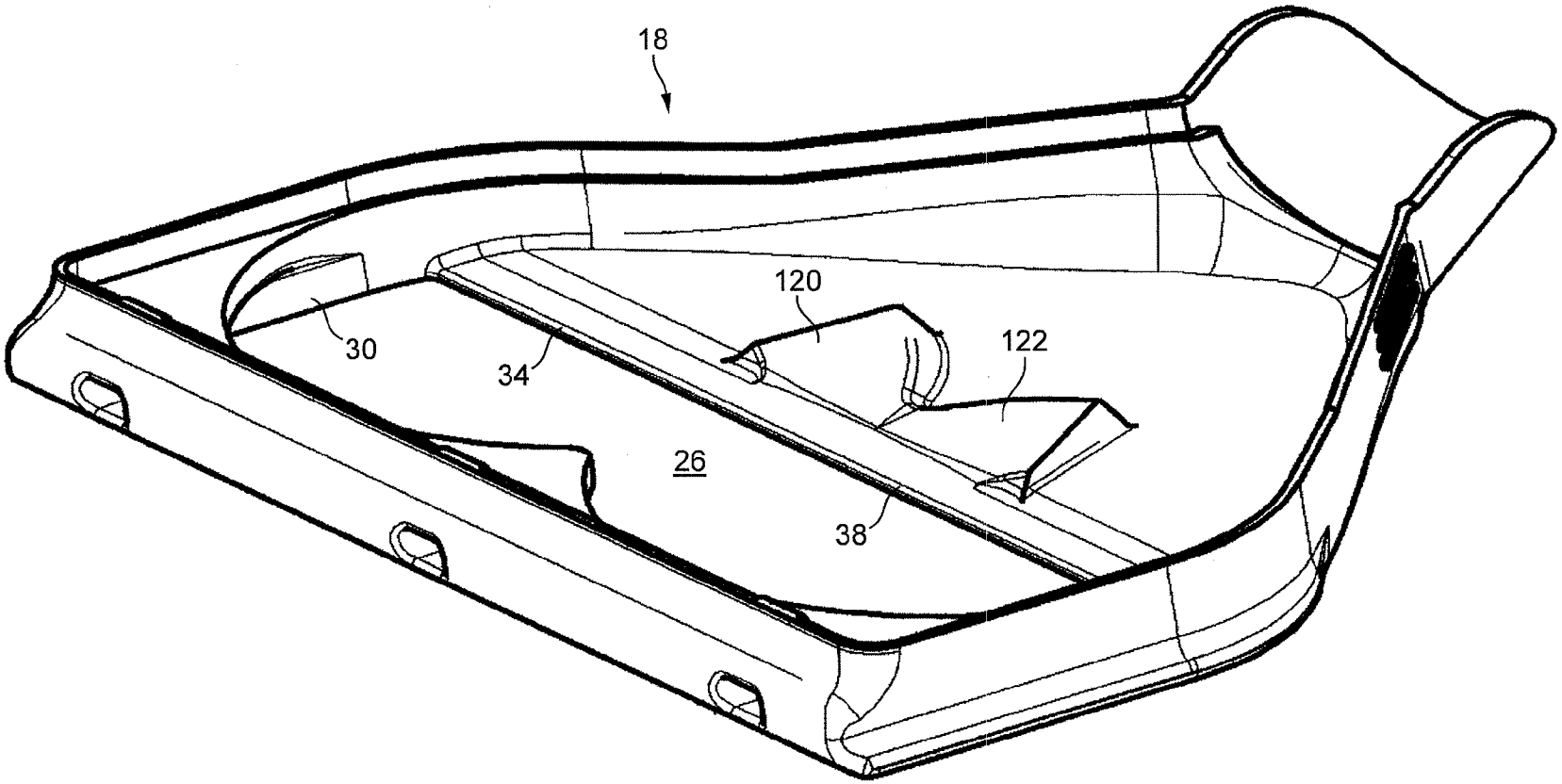
FIG. 10 is a front perspective view, from above, of the sole plate of the cleaner head.
Figure 11:
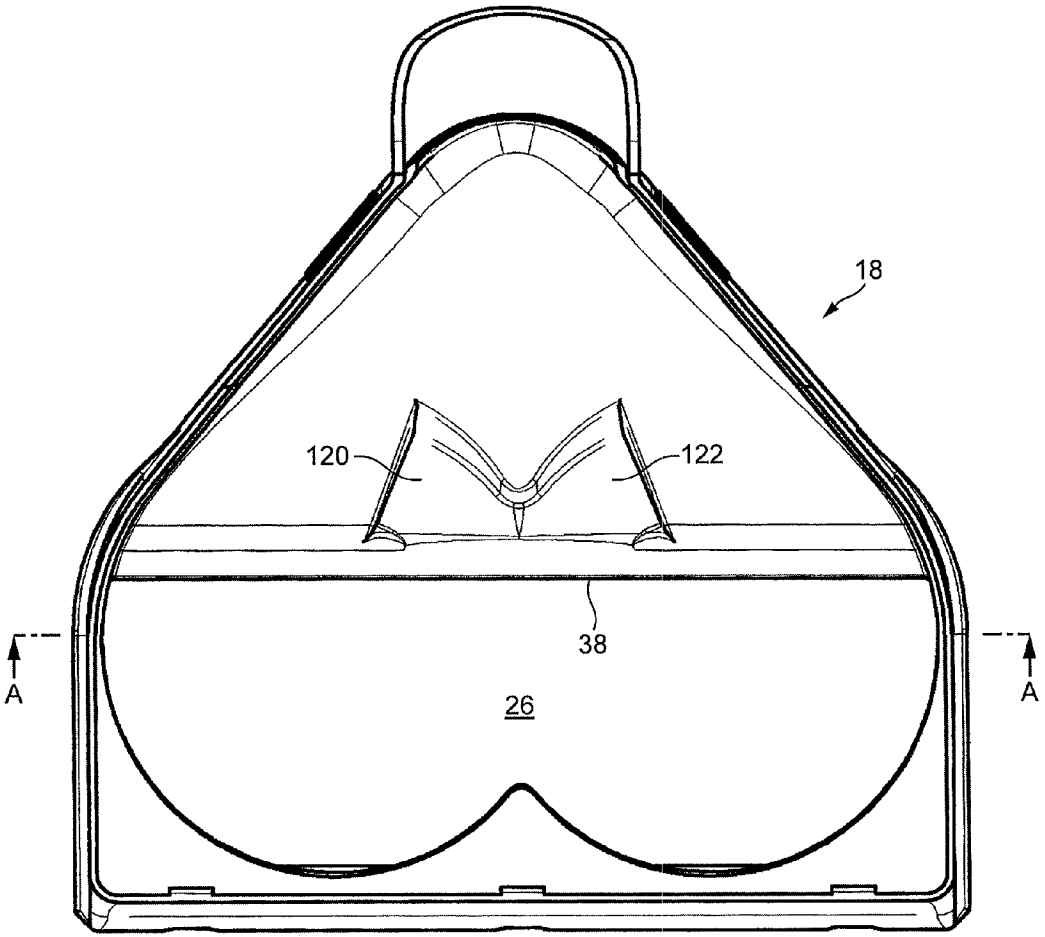
FIG. 11 is a top view of the sole plate.
Figure 12:
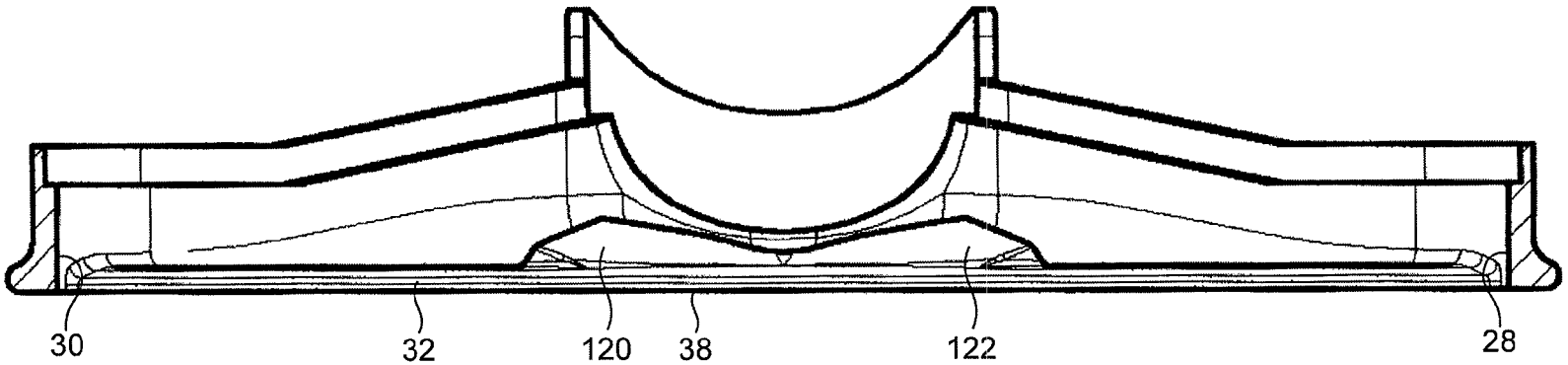
FIG. 12 is a front sectional view taken along line A-A in FIG. 10.

The sole plate 18 comprises a bottom surface 20 which, in use, faces a floor surface to be cleaned and, as described in more detail below, engages the floor surface during a cleaning operation. The bottom surface 20 is generally planar, and comprises a leading section 22 and a trailing section 24 located on opposite sides of a suction opening 26 through which a debris-bearing air flow is drawn into the cleaner head 10. The suction opening 26 is generally rectangular in shape, and is located in a suction plane SP which is indicated in FIGS. 4 and 8. With reference also to FIG. 9, the suction opening 26 is delimited by the side walls 28, 30, a relatively long front wall 32 and a relatively long rear wall 34 which each upstand from, and are integral with, the bottom surface of the sole plate 18.

The sole plate 18 comprises two working edges for agitating the fibers of a carpeted floor surface as the cleaner head 10 is maneuvered over such a surface. A front working edge 36 of the sole plate 18 is located at the intersection between the front wall 32 and the bottom surface of the leading section 22 of the sole plate 18, and extends between the side walls 28, 30. A rear working edge 38 of the sole plate 18 is located at the intersection between the rear wall 34 and the bottom surface of the trailing section 24 of the sole plate 18, and extends between the side walls 28, 30. The working edges 36, 38 are preferably relatively sharp.

The cleaner head 10 comprises an agitator assembly 40 housed within an agitator chamber 42 of the main body 12. In this example the agitator assembly 40 comprises a first agitator 44 and a second agitator 46 which are each rotatable relative to the main body 12 about a respective rotational axis $R_1$, $R_2$. The rotational axes $R_1$, $R_2$ are parallel, and are contained within a plane RP which passes through the suction opening 26. The front and rear walls 32, 34 of the suction opening 26 are generally parallel to the plane RP. The plane RP is inclined relative to the suction plane SP, and towards the rear of the suction opening 26. An angle $\alpha$ subtended between the plane RP and the suction plane SP is preferably in the range from 70 to 85°, and in this example is around 80°.

Each agitator 44, 46 comprises a body 48 which is generally in the form of an annular, disc-shaped member. The rotational axis $R_1$, $R_2$ of the agitator 44, 46 passes through the center of the body 48. The body 48 is substantially orthogonal to the rotational axis $R_1$, $R_2$ of the agitator 44, 46. The body 48 is flexible, and is preferably formed from flexible sheet material, which may be formed from silicone, elastomer, polyurethane or other rubber-like material. The body preferably has a thickness in the range from 1 to 10 mm, and in this example is around 3 mm.

The bodies 48 of the agitators 44, 46 are substantially co-planar. Each body 48 has a lower surface which is raised above, and faces, the suction opening 26. The lower surfaces of the bodies 46 are contained within a plane AP which is inclined to the suction plane SP, and towards the front of the suction opening 26. An angle $\beta$ subtended between the plane AP and the suction plane SP is preferably in the range from 5 to 20°, and in this example is around 10°.

Each body 48 is non-circular in shape. In this example, each body 48 is generally elliptical in shape, and so has a major radius $r_1$ and a minor radius $r_2$ which is perpendicular to the major radius $r_1$. However, the body 48 may have an alternative, non-circular shape. For example, the body 48 may be triangular, rectangular, or have another shape which has n-fold rotational symmetry, where n is an integer equal to or greater than 2. The body 48 of the first agitator 44 is angularly offset from the body 48 of the second agitator 46. In this example where each body 48 is generally elliptical in shape, the body 48 of the first agitator 44 is offset from the body 48 of the second agitator 46 by an angle of around 90°, but the angle by which the bodies 48 are angularly offset from one another may vary from this value depending on the shape of the bodies 48.

Each agitator 44, 46 also includes a plurality of surface engaging members, which in this example are in the form of bristles 50 mounted on the body 48 of the agitator 44, 46 so as to extend downwardly towards the sole plate 18 of the main body 12. The bristles 50 are preferably substantially orthogonal to the lower surface of the body 48, and therefore substantially parallel to the rotational axis $R_1$, $R_2$ of the agitator 44, 46. The bristles 50 are preferably formed from an electrically insulating, plastics material, such as nylon. Alternatively, at least some of the bristles 50 may be formed from a metallic or composite material in order to discharge any static electricity residing on a carpeted floor surface. As an alternative to, or in addition to, bristles 50, the agitators 44, 46 may comprise at least one strip of flexible material. The stiffness of the bristles 50 is preferably greater than the stiffness of the bodies 48 of the agitators 44, 46. Each bristle 50 has a first extremity, or bristle tip, which is located beneath the body 48 of the agitator 44, 46, and which can flex relative to the body 48 upon contact with a surface to be cleaned. Each bristle 50 also has a second extremity which is located opposite to the bristle tip, and in this example is provided by the opposite end of the bristle 50. This second extremity of the bristle 50 moves with the body 48 as it is rotated about the rotational axis $R_1$, $R_2$ of the agitator 44, 46.

The bristles 50 are preferably arranged on each body 48 so that the bristles 50 are arranged in a plurality of sets. The sets of bristles 50 are angular spaced about the rotational axis $R_1$, $R_2$ of the agitator 44, 46. Each set of bristles 50 is located towards a respective end of the body 48, and so depending on the shape of the body 48 the sets of bristles may be spaced by an angle in the range from 60 to 180°. In this example where the body 48 has a generally elliptical shape each body 48 comprises two sets 52, 54 each located towards a respective end of the elliptical body 48, and so the sets 52, 54 of bristles 50 are spaced by an angle of around 180°. However, as the body 48 of the first agitator 44 is offset from the body 48 of the second agitator 46 by an angle of around 90°, the sets 52, 54 of bristles 50 of the first agitator 44 are offset from the sets 52, 54 of bristles 50 of the second agitator 46 by an angle of around 90°.

Within each set 52, 54, the bristles 50 are arranged in a plurality of rows. The rows of bristles 50 are preferably substantially parallel, and in this example are substantially parallel to the major radius $r_1$ of the body 48. Within each row, the bristles 48 are arranged in a plurality of tufts or clumps spaced along the row, with each bristle tuft comprising between 20 and 50 individual bristles. Alternatively, each row of bristles 50 may be substantially continuous.

Each row of bristles 50 is secured to a respective bristle retaining member 56, which is in turn attached to the body 48. In this example each bristle retaining member 56 comprises five bristle tufts. Each bristle retaining member 56 is generally elliptical in shape, and comprises a groove 58 extending about the outer peripheral surface. The width of the groove 58 is smaller than the thickness of the body 48. Each bristle retaining member 56 is located within a respective elliptical aperture formed in the body 48. Each aperture has a continuous peripheral surface 60. To secure each bristle retaining member 56 to the body 48, each bristle retaining member 56 is located within a respective aperture, and the peripheral surface 60 of the aperture is manually deformed so that the peripheral surface 60 enters the groove 58. As the width of the groove 58 is smaller than the thickness of the body 48, the elastic energy which is stored in the body 48 when it is deformed urges the body 48 against the surfaces of the groove 58 as the body 48 subsequently relaxes. This engagement between the body 48 and the bristle retaining member 56 prevents the bristle retaining member 56 from becoming dislodged from the body 48 by a torque which is applied to the bristles 50 during a cleaning operation.

FIGS. 8 and 9 illustrate a drive mechanism for rotating the agitator assembly 40 relative to the main body 12 of the cleaner head 10. The drive mechanism is arranged to rotate the agitators 44, 46 at a speed in the range from 500 to 5,000 rpm, and in this example the drive mechanism is arranged to rotate the agitators 44, 46 at a speed of around 2,500 rpm. The drive mechanism comprises an air turbine assembly 70 located within a turbine chamber 72. The turbine chamber 72 is located within a cover 74 attached to the upper body section 16, and which provides an upper surface of the main body 12 of the cleaner head 10. The turbine chamber comprises a generally annular air inlet 76 through which an air flow is drawn into the turbine chamber 72 during operation of a fan unit of the vacuum cleaning appliance to which the cleaner head 10 is connected. A porous cover, such as a mesh screen, may be disposed over the air inlet 76 to inhibit the ingress of dirt and dust into the turbine chamber 74.

Air passing through the turbine chamber 74 is exhausted into an upper portion 78 of an air duct extending rearwardly from the main body 12 towards the conduit 14. The air duct has a lower portion 80 for receiving an air flow from the agitator chamber 42. The upper portion 78 of the air duct is separated from the lower portion 80 of the air duct by a partition wall 82 which is integral with the upper body section 16. The air flows passing through the upper section 78 and the lower section 80 of the air duct merge within the conduit 14 downstream from the suction opening 26 and the air inlet 76.

The turbine assembly 70 comprises an impeller 84 integral with, or mounted on, an impeller drive shaft 86 for rotation therewith. For example, the impeller 84 may be molded or pressed on to the impeller drive shaft 86. The impeller 84 comprises a circumferential array of equidistant impeller blades 88 arranged about the outer periphery of the impeller 84. One end of the impeller drive shaft 86 is rotatably mounted in a stator 90 of the turbine assembly 72. The stator 90 comprises an annular array of stator blades 92 which is arranged circumferentially about the outer periphery of an annular stator body 94 into which the impeller drive shaft 86 is inserted. The stator body 94 has substantially the same external diameter as the impeller 84, and the stator blades 92 are substantially the same size as the impeller blades 88. The impeller drive shaft 86 is supported within the bore of the stator body 94 so that the impeller blades 88 are located opposite to the stator blades 92. The stator body 94 is surrounded by annular stator frame 96 which defines with the stator body 94 an annular channel within which the stator blades 92 are located. The stator frame 96 also defines with the impeller 84 an annular channel within which the impeller blades 88 are located. The stator blades 92, stator body 94 and the stator frame 96 may be conveniently formed as a single piece. The lower end of the stator frame 96 is supported by the upper body portion 16, and the lower end of the drive shaft 86 is supported by the partition wall 82 of the upper body portion 16.

The drive mechanism further comprises a gear train for connecting the impeller 84 to the agitators 44, 46. The gears of the gear train have rotational axes which are substantially parallel to the rotational axis of the impeller 84, and to the rotational axes $R_1$, $R_2$ of the agitators 44, 46. The gear train comprises a drive gear 98 mounted on the side of the impeller 84 opposite to the stator body 94 for rotation with the impeller 84. The drive gear 98 may be connected to the impeller 84 by an interference fit. The teeth of the drive gear 98 mesh with the teeth of an input gear 100 of a compound gear. The teeth of an output gear 102 of the compound gear mesh with the teeth of a first driven gear 104. The teeth of the first driven gear 104 also mesh with the teeth of a second driven gear 106. Each of the driven gears 104, 106 may be considered to form part of a respective agitator 44, 46. Each of the driven gears 104, 106 comprises an annular agitator drive shaft 108 which passes through a respective aperture formed in the partition wall 82. Each of the driven gears 104, 106 is supported for rotation relative to the partition wall 82 by a bearing arrangement 110 located between the partition wall 82 and the agitator drive shaft 108 of the driven gear 104, 106. The compound gear may be replaced by a belt and pulley system for connecting the drive gear 98 to one of the driven gears 104, 106.

The body 48 of the first agitator 44 is connected to the end of the agitator drive shaft 108 of the first driven gear 104, and the body 48 of the second agitator 46 is connected to the end of the agitator drive shaft 108 of the second driven gear 106. Each body 48 is connected to a respective agitator drive shaft 108 by a respective annular end cap 110. Each end cap 110 comprises a pair of fingers which are inserted first into the central aperture of the body 48, and secondly into grooves 112 formed in the agitator drive shaft 108 so that the body 48 is sandwiched between the end of the agitator drive shaft 108 and the end cap 110. The end cap 110 is then secured to the agitator drive shaft 108 by a screw or bolt (not shown) which is inserted through apertures formed in the end cap 110 and the body 48 and screwed into the agitator drive shaft 108. The use of a screw, bolt, clip or other removable mechanism for connecting the cap 110 to the body 48 allows a user to remove the body 48 from the cleaner head 10, for example for repair or replacement.

Consequently, when an air flow is drawn through the turbine chamber 72 under the action of a motor-driven fan unit housed within a vacuum cleaning appliance attached to the conduit 14 the impeller 88 is rotated relative to the turbine chamber 72 by the air flow. The rotation of the impeller 88 causes the gear train to rotate, which results in the rotation of the first driven gear 104 and the second driven gear 106 in opposite directions, and so the rotation of the first agitator 44 and the second agitator 46 in opposite directions. The body 48 of each agitator 44, 46 is swept about a respective path $P_1$, $P_2$, illustrated in FIG. 7. The spacing of the rotational axes $R_1$, $R_2$ and the size of the major radius $r_1$ of the bodies 48 are selected so that the paths $P_1$, $P_2$ intersect. The paths $P_1$, $P_2$ are substantially co-planar, and so there is an overlap of the areas swept by the bodies 48 of the agitators 44, 46. The area of overlap OA is shaded in FIG. 7. The area of overlap OA is centrally located between the agitators 44, 46, and towards the rear of the suction opening 26. The angular offset of the body 48 of the first agitator 44 from the body 48 of the second agitator 46 ensures that the bodies 48 do not collide during the rotation of the agitators 44, 46 about their rotational axes $R_1$, $R_2$.

The agitator assembly 40 is arranged within the agitator chamber 42 so that not all of the bristles 50 of an agitator 44, 46 protrude through the suction opening 26 at any given moment. For example, in the angular positions of the agitators 44, 46 as illustrated in FIGS. 2 to 9, when the first set 52 of bristles of the first agitator 44 protrude through the suction opening 26 the second set 54 of bristles of the first agitator 44 are located behind the suction opening 26. The protrusion of the bristles 50 of the first set 52 of bristles of the first agitator 44 through the suction opening 26 is illustrated in FIG. 4. On the other hand, in this angular positions of the agitators 44, 46 only some of the bristles of each of the first and second sets 50, 52 of bristles of the second agitator 46 protrude through the suction opening 26.

In this example, the agitator assembly 40 is arranged within the agitator chamber 42 so that each bristle 50 protrudes through the suction opening 26 during less than one half of a revolution of its respective agitator 44, 46 about its rotational axis $R_1$, $R_2$. The angle of inclination of the bodies 48 to the suction plane 26, the spacing between the centers of the bodies 48 and the suction plane SP, and the length of the bristles 50 are selected so that, during the rotation of the agitators 44, 46 about their rotational axes $R_1$, $R_2$, the bristles 50 sweep generally arcuate areas $SA_1$ and $SA_2$ over a surface on which the cleaner head 10 is located. These swept areas $SA_1$, $SA_2$ are also identified in FIG. 7; of course the actual area swept by the bristles 50 may vary depending on the extent to which the bristles 50 splay upon contact with the surface to be cleaned, the extent of the wear of the bristles, the evenness of the surface to be cleaned and, for a carpeted floor surface, the extent to which the carpet is sucked towards or into the suction opening 26. Each swept area $SA_1$, $SA_2$ extends generally from a respective side wall 28, 30 of the suction opening 26 to the center of the suction opening 26, and passes close to the front wall 32 of the suction opening 26 at its mid-point. The swept areas $SA_1$, $SA_2$ may overlap towards the center of the suction opening 26.

In use, the bottom surface 20 of the sole plate 18 is located on a surface to be cleaned. As those bristles 50 which are protruding through the suction opening 26 engage the surface to be cleaned, the portion or portions of the bodies 48 of the agitators 44, 46 bearing those bristles 50 flex upwardly towards the agitator drive shaft 108 so that the bristles 50 are generally perpendicular to the surface. This flexing of the bodies 48 also causes the second extremities of the bristles 50 to move upwardly towards the agitator drive shaft 108 with the body 48. The spacing between the upper surface of the body 48 and the agitator chamber 42 is selected so that the body 48 does not come into contact with the agitator chamber 42 when it flexes upwardly upon contact with the surface to be cleaned. In this example, the upper surface of the flexed portion of the body 48 is preferably spaced from the agitator chamber 42 by a distance in the range from 1 to 5 mm so as to avoid any wear of the body 48 during use of the cleaner head 10 through contact between the agitator chamber 42 and the body 48.

As the bristles 50 are also flexible, the bristles 50 of the bristle tufts which are located closest to the front working edge 36 of the sole plate 18, and thus protrude through the suction opening 26 to the greatest extent, tend to splay apart. When the vacuum cleaning appliance to which the cleaner head 10 is attached is switched on, the fan unit of the appliance draws a first air flow into the agitator chamber 42 through the suction opening 26, and a second air flow into the turbine chamber 74 through the air inlet 76. As mentioned above, the second air flow rotates the impeller 88, which causes the agitators 44, 46 to rotate in opposite directions to sweep the bristles 50 of the agitators 44, 46 over arcuate areas $SA_1$ and $SA_2$ of the surface to be cleaned. The sweeping movement of the tips of the bristles 50 over the surface tends to cause any relatively large debris, including fibers or hairs, located on the surface to agglomerate into a mass located in front of and/or beneath the tips of the bristles 50. This mass of fibers can be readily entrained within the first air flow, and so pass into the conduit 14 via the agitator chamber 42 and the lower portion 80 of the duct to be conveyed to the appliance.

As the bristle tufts are swept over these areas, the bristles 50, and the portions of the bodies 48 bearing the bristles 50, flex by varying amounts. As the bristles tend to splay apart towards the front of the suction opening 26, relatively small debris can become lodged between the bristles 50, which then can become trapped as the bristles 50 relax as they leave the surface to be cleaned.

To dislodge this debris from the bristles 50, the cleaner head 10 comprises a pair of ramps 120, 122 over which the bristles 50 are swept with rotation of the agitators 44, 46. With reference to FIGS. 8 to 12, each ramp 120, 122 is connected to, and preferably integral with, the sole plate 18. The ramps 120, 122 are connected to the upper surface of the sole plate 18 so that they are located adjacent, and preferably immediately behind, the rear wall 32 of the suction opening 26 so that the ramps 120, 122 engage bristles 50 located behind the suction opening 26. Each ramp 120, 122 is inclined to the suction plane SP. The angle of inclination of the ramp 120, 122 to the suction plane SP may vary along the length of the ramp 120, 122 but in this embodiment the angle of inclination of the ramp 120, 122 to the suction plane SP is relatively constant along the length of the ramp 120, 122. The angle of inclination of the ramp 120, 122 is generally the same as the angle β subtended between the plane AP and the suction plane SP.

The height and the inclination of the ramps 120, 122 may be selected so that the bristles 50 are in contact with the ramp 120, 122 over substantially the entire length of the ramp 120, 122. Alternatively, the bristles 50 may only engage the ramp 120, 122 towards the end of the ramp 120, 122. Each ramp 120, 122 extends in an arc about the rotational axis $R_1$, $R_2$ of a respective agitator 44, 46 so that each bristle 50 of that agitator 44, 46 is in contact with the ramp 120, 122 over a period of the revolution of the bristle 50 about the rotational axis of the agitator. In this example, each ramp 120, 122 extends about the rotational axis of its respective agitator 44, 46 by an angle of around 70°. As the bristles 50 are swept over the ramp 120, 122, the bristles 50 splay apart to release debris that had become trapped therebetween. This released debris may then become entrained within the first air flow passing through the cleaner head 10.

The invention claimed is:

1. A cleaner head for a cleaning appliance, the cleaner head comprising:

a rotatable agitator comprising a drive shaft, a body connected to the drive shaft, and at least one surface engaging member mounted on the body, each surface engaging member having a first extremity for engaging a surface to be cleaned and a second extremity located opposite to the first extremity and which is moveable relative to the drive shaft upon engagement between the first extremity and the surface;

an agitator chamber housing the agitator, the agitator chamber comprising a downwardly-directed opening through which debris energized by said at least one surface engaging member enters the cleaner head, the opening being located in a plane; and a system for rotating the agitator about a rotational axis of the drive shaft, the rotational axis being inclined both relative to the plane of the opening and towards the rear of the opening so that, with rotation of the agitator, said at least one surface engaging member protrudes through the opening towards the front of the opening.

2. The cleaner head of claim 1, wherein said at least one surface engaging member is connected to a part of the body which is moveable relative to the drive shaft upon engagement between the first extremity of the surface engaging member and the surface to be cleaned.

3. The cleaner head of claim 1, wherein the body is flexible.

4. The cleaner head of claim 1, wherein an angle subtended between the rotational axis and the plane of the opening is in the range from 70 to 85°.

5. The cleaner head of claim 1, wherein the body is disc-shaped.

6. The cleaner head of claim 1, wherein the body is annular.

7. The cleaner head of claim 1, wherein the body is generally planar in shape, and is preferably formed from sheet material.

8. The cleaner head of claim 1, wherein the body is non-circular.

9. The cleaner head of claim 8, wherein the body has n-fold rotational symmetry, where n is an integer equal to or greater than 2.

10. The cleaner head of claim 1, wherein the body is generally elliptical in shape.

11. The cleaner head of claim 1, wherein said at least one surface engaging member comprises a plurality of surface engaging members mounted on the body.

12. The cleaner head of claim 11, wherein the surface engaging members are arranged in a plurality of rows mounted on the body.

13. The cleaner head of claim 12, wherein the rows of surface engaging members are substantially parallel.

14. The cleaner head of claim 13, wherein the rows of surface engaging members are arranged substantially parallel to a major radius of the body.

15. The cleaner head of claim 1, wherein the system for rotating the agitator comprises an air turbine assembly, the air turbine assembly comprising an impeller for driving the agitator.

16. The cleaner head of claim 15, wherein the air turbine assembly comprises a drive mechanism for connecting the agitator to the impeller.

17. The cleaner head of claim 16, wherein the drive mechanism is located above the agitator.

18. The cleaner head of claim 16, wherein the drive mechanism comprises a plurality of gears.

19. The cleaner head of claim 15, wherein the opening is arranged to admit a first air flow into the agitator chamber, the cleaner head comprising a turbine air inlet for admitting a second air flow to the air turbine assembly and a duct for receiving the first air flow from the agitator chamber and the second air flow from the air turbine assembly.

20. The cleaner head of claim 19, wherein the turbine air inlet is located behind the agitator.

21. The cleaner head of claim 19, wherein the turbine air inlet is located behind the opening.

22. The cleaner head of claim 1, wherein the body is located above the opening.

23. The cleaner head of claim 1, comprising a plurality of said agitators each having a rotational axis which is inclined both relative to the plane of the opening and towards the rear edge of the opening so that, with rotation of the agitator, the at least one surface engaging member of the agitator protrudes through the opening towards the front edge of the opening.

* * * * *